US012492705B2

(12) United States Patent
Chang et al.

(10) Patent No.: US 12,492,705 B2
(45) Date of Patent: Dec. 9, 2025

(54) WATER PUMP STRUCTURE AND ROTOR THEREOF

(71) Applicant: SUNONWEALTH ELECTRIC MACHINE INDUSTRY CO., LTD., Kaohsiung (TW)

(72) Inventors: En-Cheng Chang, Kaohsiung (TW); Ming-Tsung Li, Kaohsiung (TW)

(73) Assignee: SUNONWEALTH ELECTRIC MACHINE INDUSTRY CO., LTD., Kaohsiung (TW)

( * ) Notice: Subject to any disclaimer, the term of this patent is extended or adjusted under 35 U.S.C. 154(b) by 0 days.

(21) Appl. No.: 18/889,419

(22) Filed: Sep. 19, 2024

(65) Prior Publication Data

US 2025/0101991 A1 Mar. 27, 2025

(30) Foreign Application Priority Data

Sep. 22, 2023 (TW) ..... 112210285

(51) Int. Cl.
*F04D 29/22* (2006.01)
*F04D 1/00* (2006.01)
*F04D 29/42* (2006.01)

(52) U.S. Cl.
CPC ..... *F04D 29/2261* (2013.01); *F04D 1/00* (2013.01); *F04D 29/426* (2013.01)

(58) Field of Classification Search
CPC . F04D 13/0673; F04D 29/2261; F04D 29/245
See application file for complete search history.

(56) References Cited

U.S. PATENT DOCUMENTS

2005/0178526 A1* 8/2005 Naganawa ..... H01L 23/473 257/E23.098
2019/0219056 A1* 7/2019 Jang ..... F04D 29/426

FOREIGN PATENT DOCUMENTS

| | | | |
|---|---|---|---|
| CN | 1275255 | A | 11/2000 |
| CN | 105370584 | A | 3/2016 |
| CN | 207184192 | U | 4/2018 |
| CN | 109790841 | A | 5/2019 |
| CN | 210839109 | U | 6/2020 |
| CN | 112534141 | A | 3/2021 |
| CN | 113309734 | A | 8/2021 |
| CN | 114060286 | A | 2/2022 |
| JP | 2006299975 | A | 11/2006 |

* cited by examiner

*Primary Examiner* — Brian O Peters
(74) *Attorney, Agent, or Firm* — WPAT, PC

(57) ABSTRACT

A water pump structure and a rotor thereof are provided. The water pump structure includes a housing, a rotor, a stator, and an isolation component. The rotor is disposed in the housing. The rotor includes an impeller. The impeller has a central hole, an outer edge and at least one groove. The at least one groove is in communication with the central hole. The at least one groove extends outward from an inner edge of the central hole to the outer edge of the impeller. The stator is disposed around a periphery of the rotor. The isolation component is disposed between the rotor and the stator and configured to isolate the rotor from the stator.

19 Claims, 11 Drawing Sheets

WATER PUMP STRUCTURE AND ROTOR THEREOF

BACKGROUND

1. Field of the Disclosure

The present disclosure relates to a water pump structure and a rotor thereof, and to a water pump structure and a rotor thereof that may prevent the accumulation of bubbles.

2. Description of the Related Art

During operations of a water pump, it is common for air to enter the water pump along with the water flow. However, air bubbles formed in the water flow easily accumulate near the center of rotation above an impeller, causing the shaft sleeve (or bearing) to lose lubrication and wear out. This not only shortens the service life of the shaft sleeve (or bearing) but also increases the gap between the shaft sleeve (or bearing) and the shaft, affecting the stability of rotation.

SUMMARY

In some embodiments, a water pump structure includes a housing, a rotor, a stator, and an isolation component. The rotor is disposed in the housing. The rotor includes an impeller. The impeller has a central hole, an outer edge and at least one groove. The at least one groove is in communication with the central hole. The at least one groove extends outward from an inner edge of the central hole to the outer edge of the impeller. The stator is disposed around a periphery of the rotor. The isolation component is disposed between the rotor and the stator and configured to isolate the rotor from the stator.

In some embodiments, a rotor includes an impeller. The impeller has a central hole, an outer edge and at least one groove. The at least one groove is in communication with the central hole. The at least one groove extends outward from an inner edge of the central hole to the outer edge of the impeller.

BRIEF DESCRIPTION OF THE DRAWINGS

Aspects of some embodiments of the present disclosure are readily understood from the following detailed description when read with the accompanying figures. It is noted that various structures may not be drawn to scale, and dimensions of the various structures may be arbitrarily increased or reduced for clarity of discussion.

DETAILED DESCRIPTION

Figure 1:
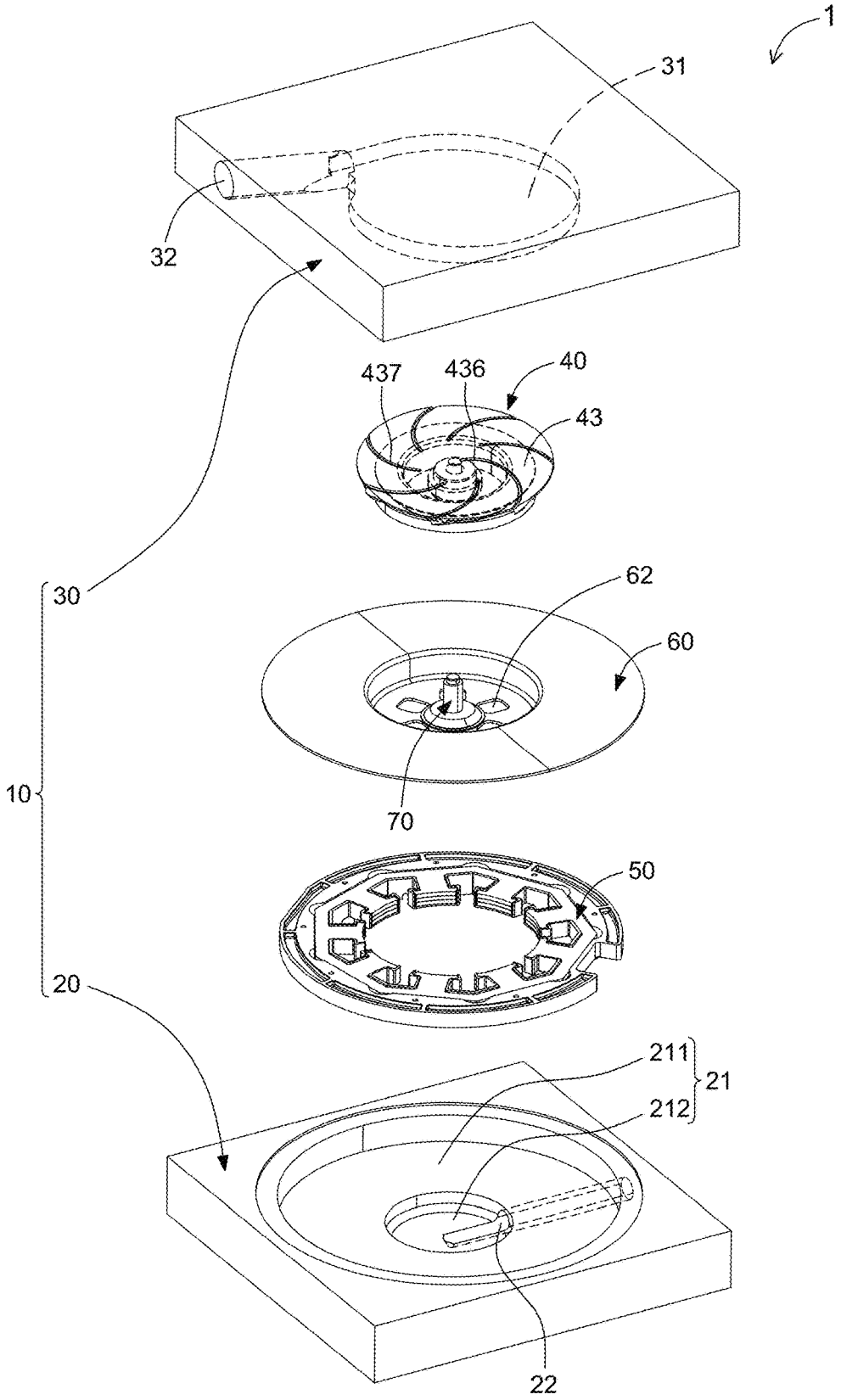
FIG. 1 illustrates an exploded perspective view of a water pump structure according to some embodiments of the present disclosure.
Figure 2:
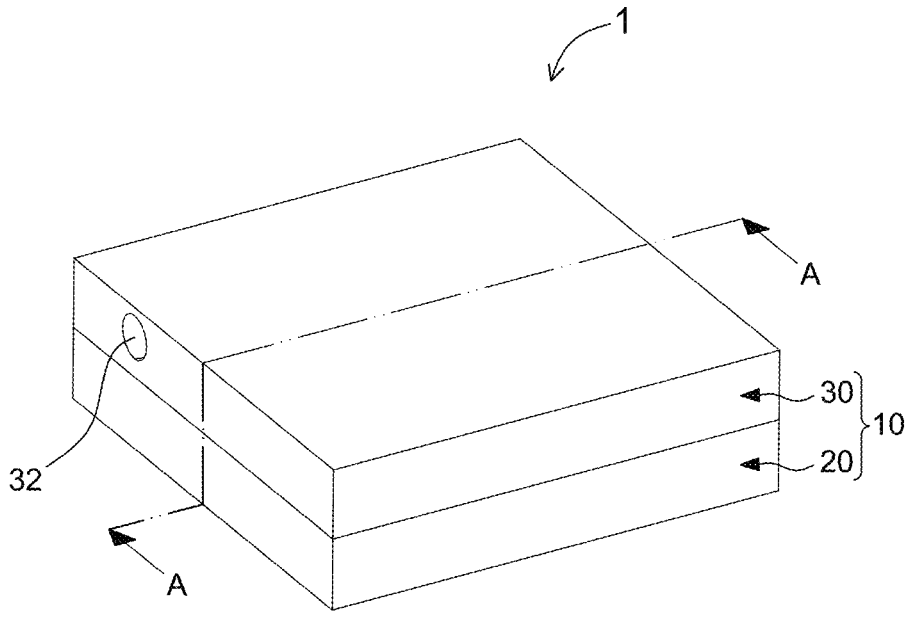
FIG. 2 illustrates an assembly view of a water pump structure according to some embodiments of the present disclosure.
Figure 3:
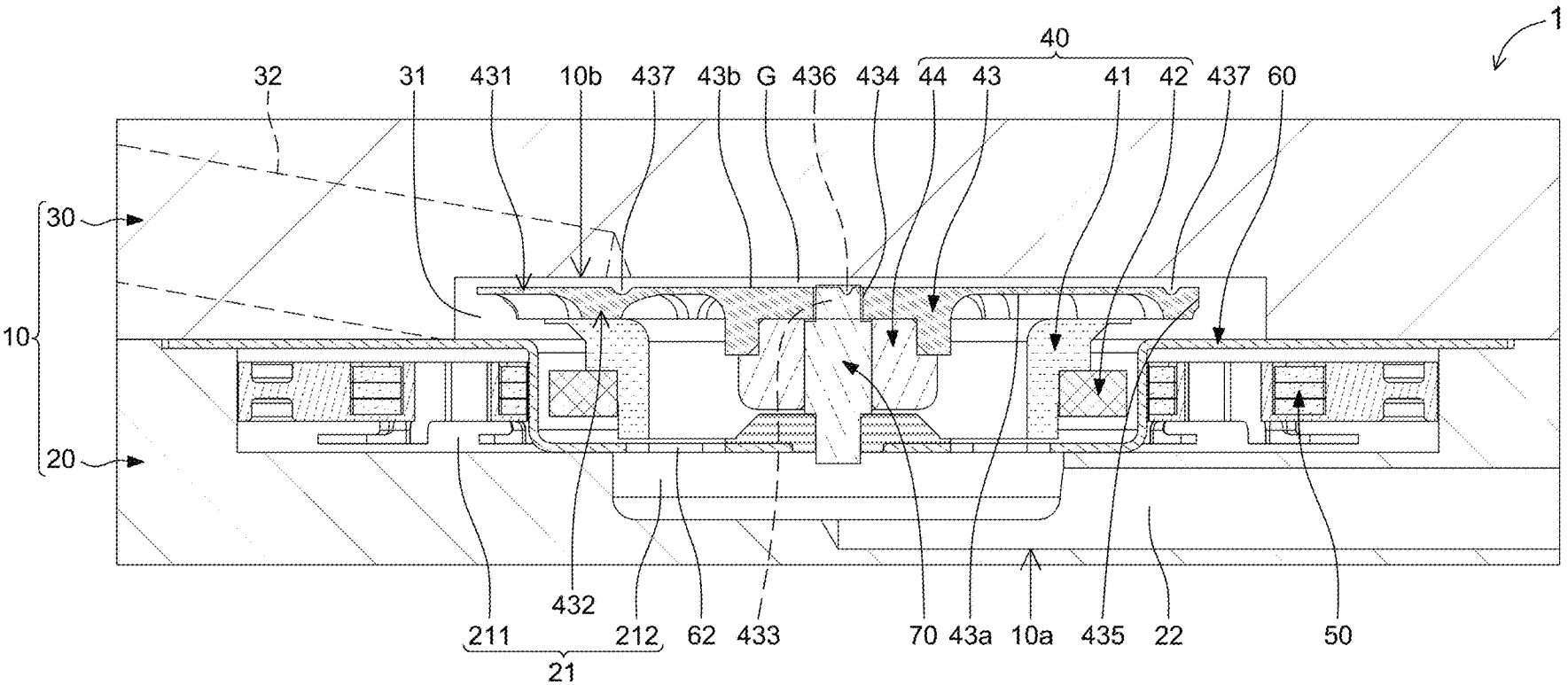
FIG. 3 illustrates a cross-sectional view along line A-A of FIG. 2 of a water pump structure according to some embodiments of the present disclosure.

FIG. 1 illustrates an exploded perspective view of a water pump structure 1 according to some embodiments of the present disclosure. FIG. 2 illustrates an assembly view of a water pump structure 1 according to some embodiments of the present disclosure. FIG. 3 illustrates a cross-sectional view along line A-A of FIG. 2 of a water pump structure 1 according to some embodiments of the present disclosure. Referring to FIG. 1 through FIG. 3, the water pump structure 1 can include a housing 10, a rotor 40, a stator 50, an isolation component 60, and a pivot shaft 70.

In some embodiments, as shown in FIG. 1 and FIG. 3, the housing 10 can include a first cover 20 and a second cover 30. The first cover 20 can have a first accommodating recess 21 and a water inlet channel 22. The first accommodating recess 21 can include an upper recess portion 211 and a lower recess portion 212. The lower recess portion 212 is located below and in communication with the upper recess portion 211. In some embodiments, a width (or diameter) of the upper recess portion 211 can greater than a width (or diameter) of the lower recess portion 212. The water inlet channel 22 can communicate with the first accommodating recess 21 (e.g., the lower recess portion 212). In some embodiments, a side of the housing 10 adjacent to the water inlet channel 22 can be defined as "a water inlet side 10*a*."

The second cover 30 can be combined with the first cover 20. The second cover 30 can have a second accommodating recess 31 and a water outlet channel 32. The second accommodating recess 31 is opposite to the first accommodating recess 21. The water outlet channel 32 can communicate with the second accommodating recess 31. In some embodiments, a side of the housing 10 adjacent to the water outlet channel 32 can be defined as "a water outlet side 10*b*." The water outlet side 10*b* is opposite to the water inlet side 10*a*.

Figure 4:
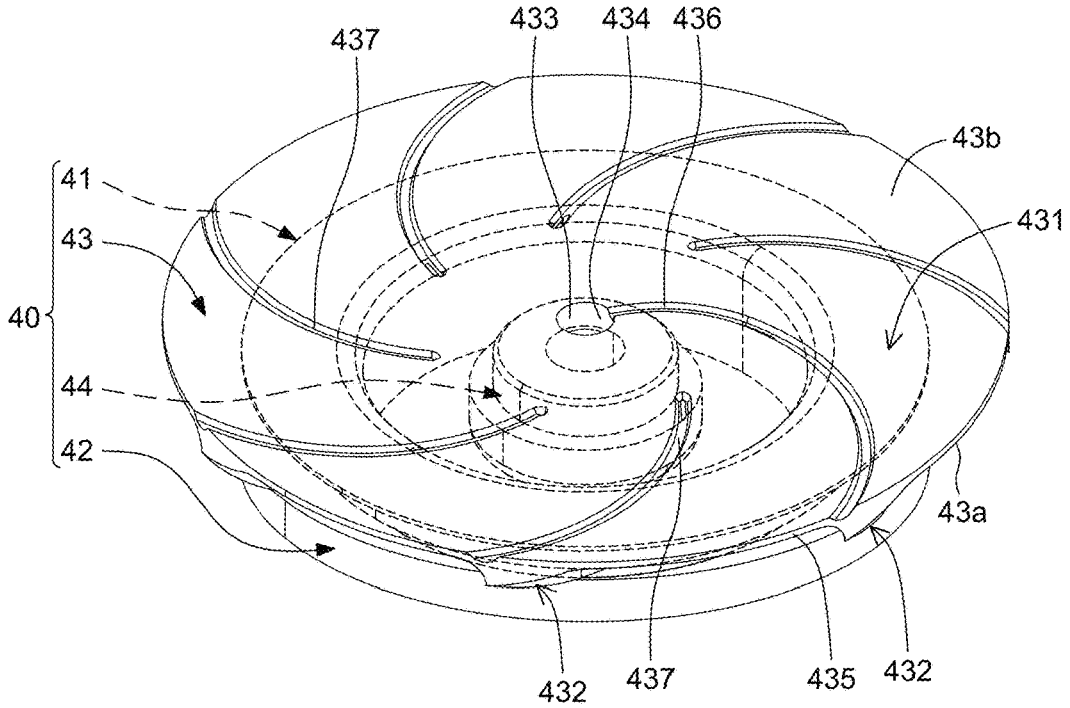
FIG. 4 illustrates an assembly view of a rotor according to some embodiments of the present disclosure.

FIG. 4 illustrates an assembly view of a rotor 40 according to some embodiments of the present disclosure. Referring to FIG. 3 and FIG. 4, the rotor 40 is disposed in the housing 10. In some embodiments, the rotor 40 can include a bearing seat 41, a rotor magnet 42, an impeller 43, and a shaft sleeve (or bearing) 44. The bearing seat 41 can be configured to support the impeller 43. The rotor magnet 42 can be disposed around the bearing seat 41. The impeller 43 can be disposed on the bearing seat 41. There is a gap G between the impeller 43 and the second cover 30 (or the water outlet side 10*b*). The shaft sleeve 44 can be disposed in the bearing seat 41 and sleeved on the pivot shaft 70 (FIG. 3).

Figure 5:
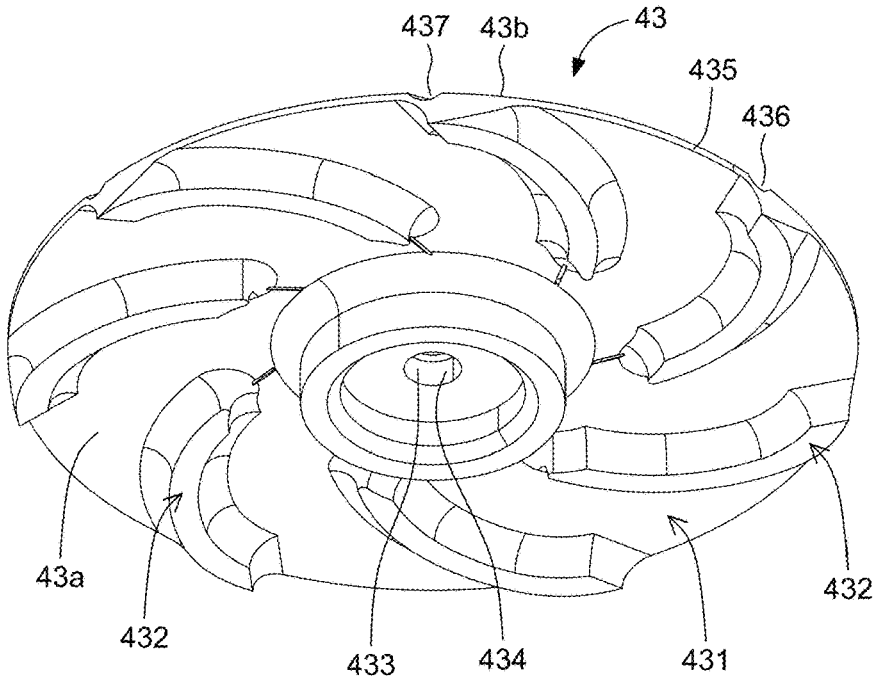
FIG. 5 illustrates a perspective view of an impeller according to some embodiments of the present disclosure.

FIG. 5 illustrates a perspective view of an impeller 43 according to some embodiments of the present disclosure.

Figure 6:
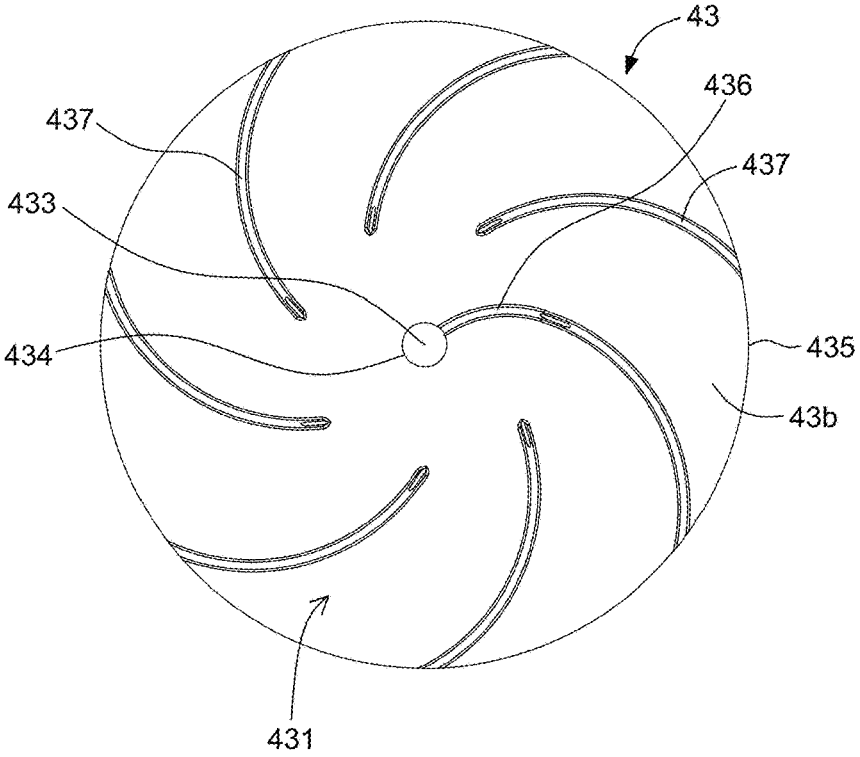
FIG. 6 illustrates a top view of an impeller according to some embodiments of the present disclosure.
Figure 7:
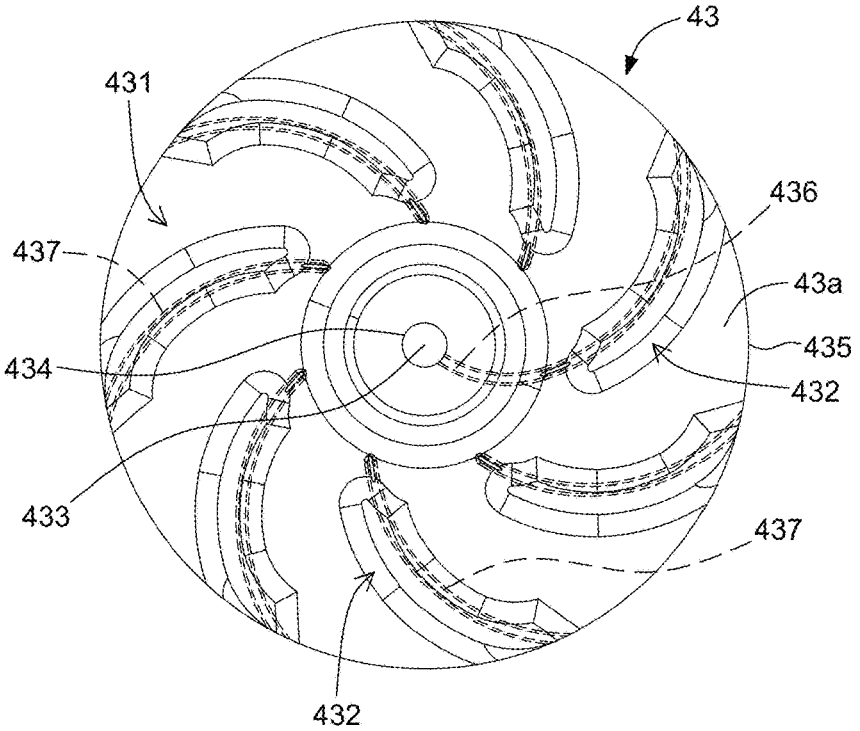
FIG. 7 illustrates a bottom view of an impeller according to some embodiments of the present disclosure.
Figure 8:
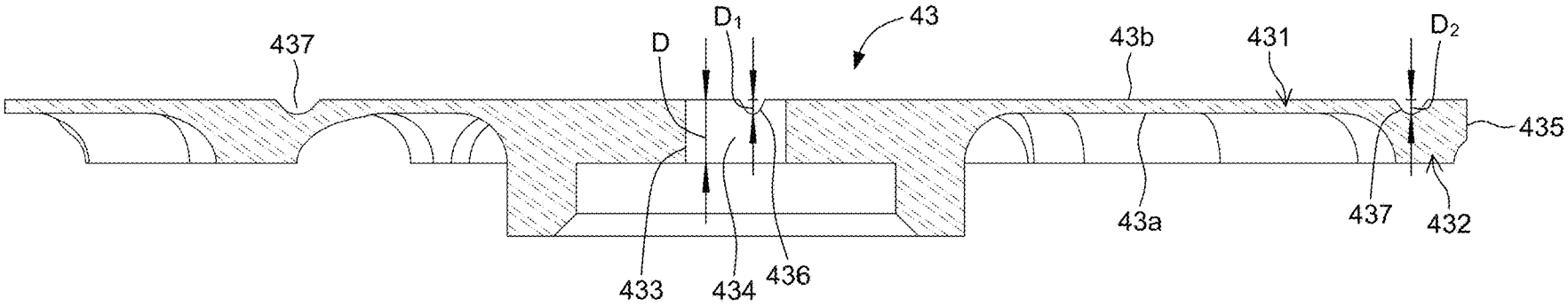
FIG. 8 illustrates a cross-sectional view of an impeller according to some embodiments of the present disclosure.

FIG. 6 illustrates a top view of an impeller 43 according to some embodiments of the present disclosure. FIG. 7 illustrates a bottom view of an impeller 43 according to some embodiments of the present disclosure. FIG. 8 illustrates a cross-sectional view of an impeller 43 according to some embodiments of the present disclosure. Referring to FIG. 3, FIG. 4, and FIG. 5 through FIG. 8, in some embodiments, the impeller 43 can include a hub 431 and a plurality of blades 432. The impeller 43 can have a first surface 43*a*, a second surface 43*b*, a central hole 433, an outer edge 435, at least one groove 436, and at least one guiding slot 437. The hub 431 can have a lower surface (e.g., the first surface 43*a*) and an upper surface (e.g., the second surface 43*b*) opposite to the lower surface. The plurality of blades 432 can be disposed on the lower surface (e.g., the first surface 43*a*) of the hub 431. The plurality of blades 432 can protrude downward from the lower surface (e.g., the first surface 43*a*) (FIG. 5). The first surface 43*a* can face the water inlet side 10*a*. The second surface 43*b* is opposite to the first surface 43*a*. The second surface 43*b* can face away from the water inlet side 10*a* and towards the water outlet side 10*b*. The central hole 433 is located in the center of the hub 431. The central hole 433 extends through the hub 431 (i.e., communicating with the lower surface (e.g., the first surface 43*a*) and the upper surface (e.g., the second surface 43*b*)). In addition, the central hole 433 can have an inner edge 434. The outer edge 435 can be the outermost edge of the hub 431.

In some embodiments, as shown in FIG. 4 and FIG. 6, the at least one groove 436 can be recessed from the second surface 43*b* and in communication with the central hole 433. In some embodiments, the at least one groove 436 can extend outward from the inner edge 434 of the central hole 433 to the outer edge 435 of the impeller 43 (e.g., the outermost edge of the hub 431). In some embodiments, the at least one groove 436 can extend outward from the inner edge 434 of the central hole 433 along an arc-shaped path to the outer edge 435 of the impeller 43 (e.g., the outermost edge of the hub 431). In some embodiments, as shown in FIG. 3, the at least one groove 436 can face away from the water inlet side 10*a* and the water inlet channel 22. The at least one groove 436 can face the water outlet side 10*b* and in communication with the gap G. In some embodiments, the at least one groove 436 can be further away from the water inlet side 10*a* than the rotor magnet 42 is. In some embodiments, the at least one groove 436 can be further away from the water inlet side 10*a* than the shaft sleeve 44 is. In some embodiments, as shown in FIG. 4, FIG. 5 and FIG. 7, the at least one groove 436 and the plurality of blades 432 can be located on two different sides of the hub 431. A downward projection of a portion of the at least one groove 436 can overlap an upward projection of one of the plurality of blades 432. In some embodiments, the at least one groove 436 can be misaligned with the blades 432 (e.g., projections do not overlap). In some embodiments, the shape of the at least one groove 436 can conform to the shape of the blades 432. In some embodiments, as shown in FIG. 8, a width of the at least one groove 436 can taper downward. A depth $D_1$ of the at least one groove 436 can be less than a depth D of the central hole 433. In some embodiments, the depth $D_1$ of the at least one groove 436 can be equal to the depth D of the central hole 433. In some embodiments, the at least one groove 436 can include a plurality of grooves 436.

In some embodiments, as shown in FIG. 4 and FIG. 6, the at least one guiding slot 437 can be recessed from the second surface 43*b*. The at least one guiding slot 437 can extend inward from the outer edge 435 (e.g., the outermost edge of the hub 431). In some embodiments, the at least one guiding slot 437 can extend inward along an arc-shaped path from the outer edge 435 (e.g., the outermost edge of the hub 431). The at least one guiding slot 437 can be free from communicating with the central hole 433. In some embodiments, an extension length of the at least one groove 436 can be greater than an extension length of the at least one guiding slot 437. In some embodiments, as shown in FIG. 3, the at least one guiding slot 437 can face away from the water inlet side 10*a* and the water inlet channel 22. The at least one guiding slot 437 can face the water outlet side 10*b* and communicate with the gap G. In some embodiments, the at least one guiding slot 437 can be further away from the water inlet side 10*a* than the rotor magnet 42 is. In some embodiments, the at least one guiding slot 437 can be further away from the water inlet side 10*a* than the shaft sleeve 44 is. In some embodiments, as shown in FIG. 4, FIG. 5 and FIG. 7, the at least one guiding slot 437 can include a plurality of guiding slots 437. An amount of the plurality of guiding slots 437 can be less than an amount of the plurality of blades 432. In some embodiments, as shown in FIG. 8, a width of the at least one guiding slot 437 can taper downward. A depth $D_2$ of the at least one guiding slot 437 can be less than the depth D of the central hole 433. In some embodiments, the depth $D_2$ of the at least one guiding slot 437 can be equal to the depth D of the central hole 433. In some embodiments, the depth $D_1$ of the at least one groove 436 can be greater than the depth $D_2$ of the at least one guiding slot 437. In some embodiments, the depth $D_1$ of the at least one groove 436 can be equal to the depth $D_2$ of the at least one guiding slot 437. In some embodiments, the shape of the at least one guiding slot 437 can conform to the shape of the blades 432. In some embodiments, as shown in FIG. 4, FIG. 5 and FIG. 7, the at least one guiding slot 437 and the plurality of blades 432 can be located on two different sides of the hub 431. A downward projection of a portion of the at least one guiding slot 437 can overlap an upward projection of at least one of the plurality of blades 432. In some embodiments, the at least one guiding slot 437 can be misaligned with the blades 432 (e.g., projections do not overlap).

Referring again to FIG. 1 and FIG. 3, the stator 50 can be disposed in the first accommodating recess 21 (e.g., the upper recess portion 211) of the first cover 20. The stator 50 can be disposed around a periphery of the rotor 40. The isolation component 60 can be disposed between the rotor 40 and the stator 50 and configured to isolate the rotor 40 from the stator 50. In some embodiments, the isolation component 60 can have a plurality of openings 62 to allow water from the water inlet side 10*a* to flow through the plurality of openings 62 to the water outlet side 10*b*. In some embodiments, the pivot shaft 70 can be disposed on the center of the isolation component 60.

In the embodiment illustrated in FIG. 1 to FIG. 8, the bubbles accumulated around the rotating center (e.g., around the central hole 433) above the impeller 43 can be dispersed by the at least one groove 436 and discharged along the at least one groove 436 and from the outer edge 435. In addition, the bubbles dispersed by the at least one groove 436 can flow towards the at least one guiding slot 437 and be discharged along the at least one guiding slot 437 and from the outer edge 435. Since the bubbles will no longer accumulate around the rotating center (e.g., around the central hole 433) above the impeller 43, the lubrication of the shaft sleeve 44 can be maintained and the wear of the shaft sleeve 44 can be avoided, thereby extending the service life of the shaft sleeve 44 and preventing the gap between the shaft sleeve 44 and the pivot shaft 70 from expanding, significantly improving the stability of rotation.

Figure 9:
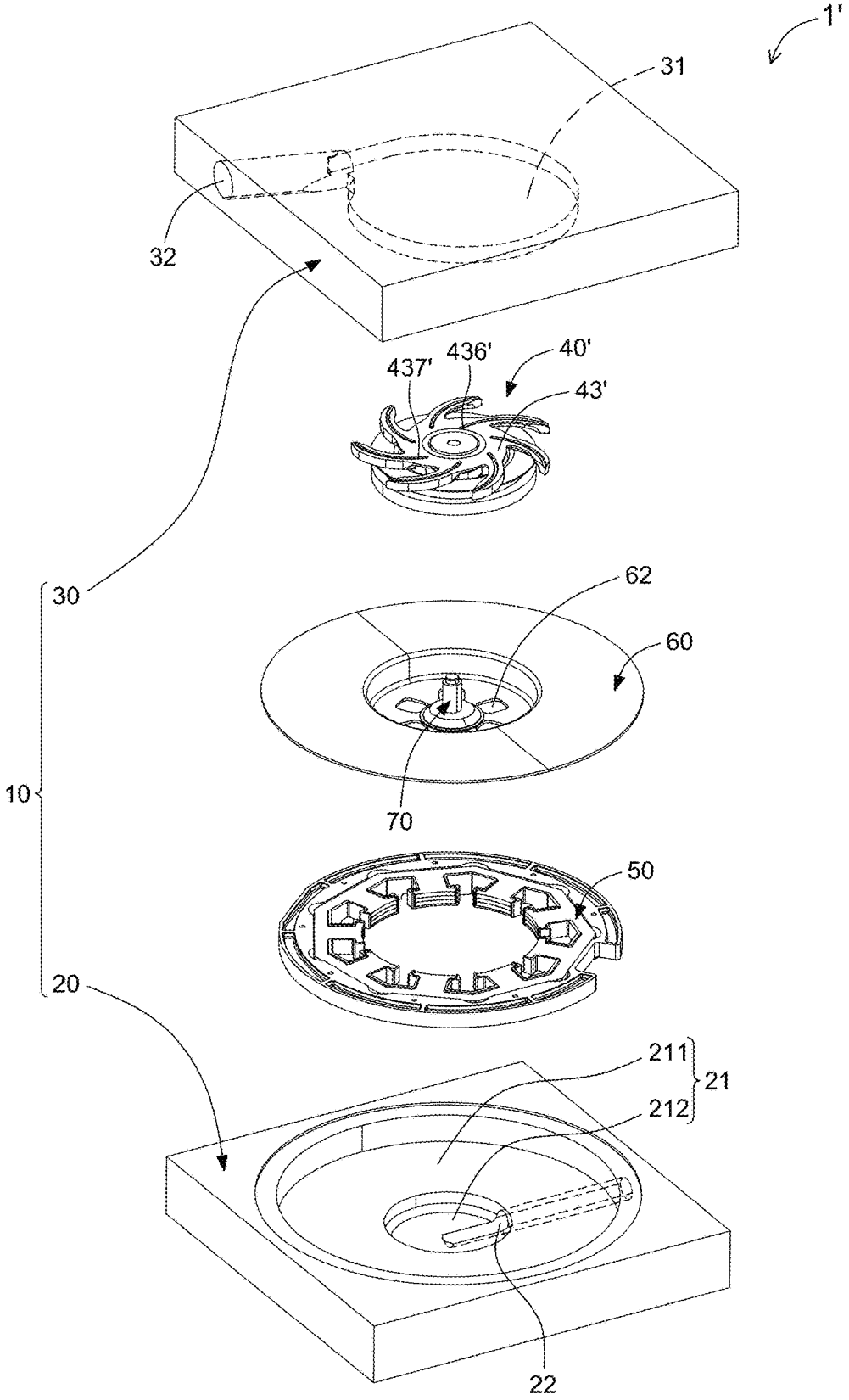
FIG. 9 illustrates an exploded perspective view of a water pump structure according to some embodiments of the present disclosure.
Figure 10:
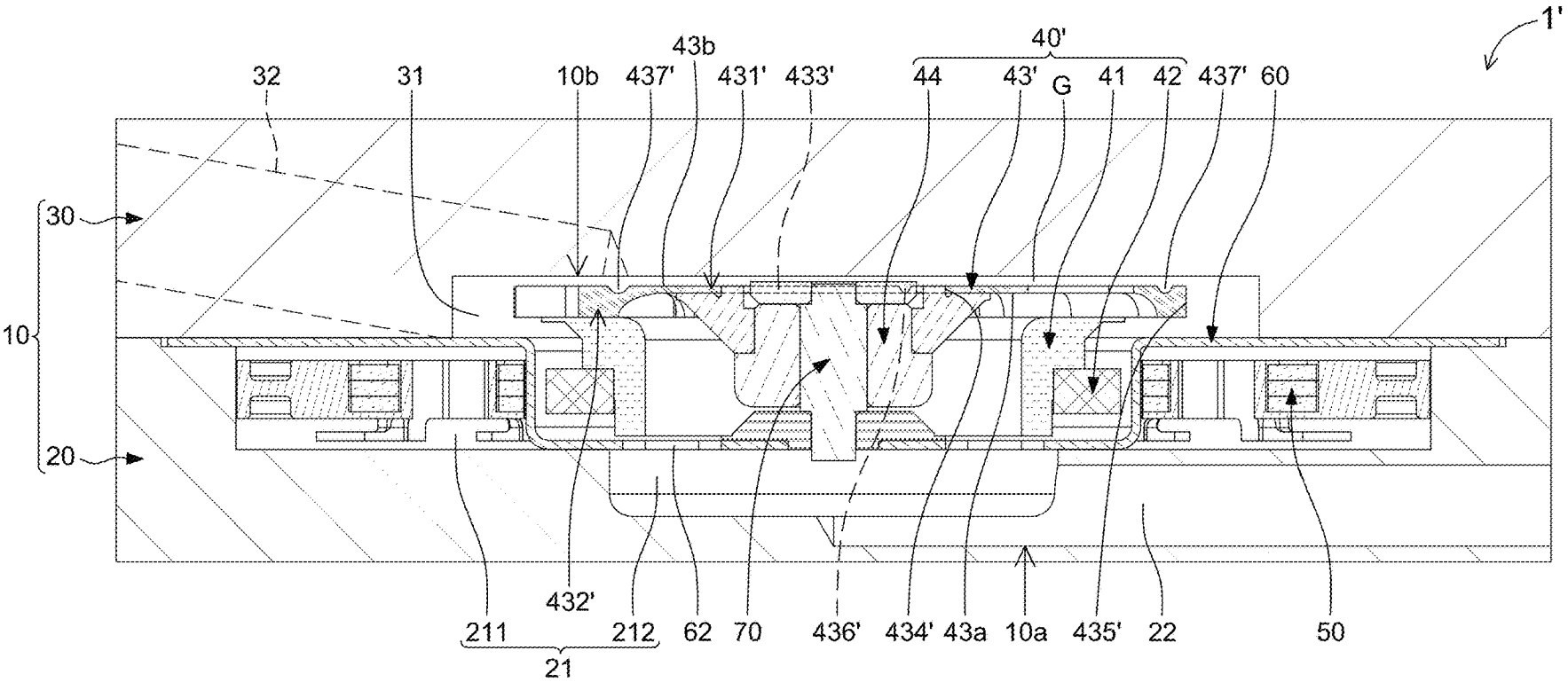
FIG. 10 illustrates a cross-sectional view of a water pump structure according to some embodiments of the present disclosure.
Figure 11:
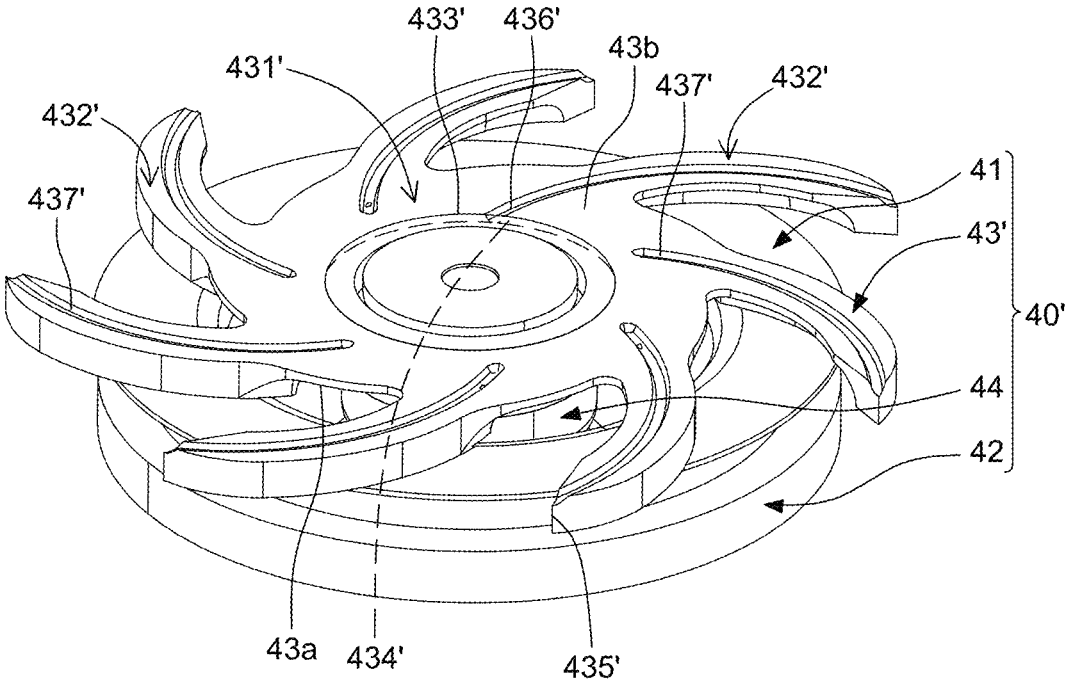
FIG. 11 illustrates an assembly view of a rotor according to some embodiments of the present disclosure.
Figure 12:
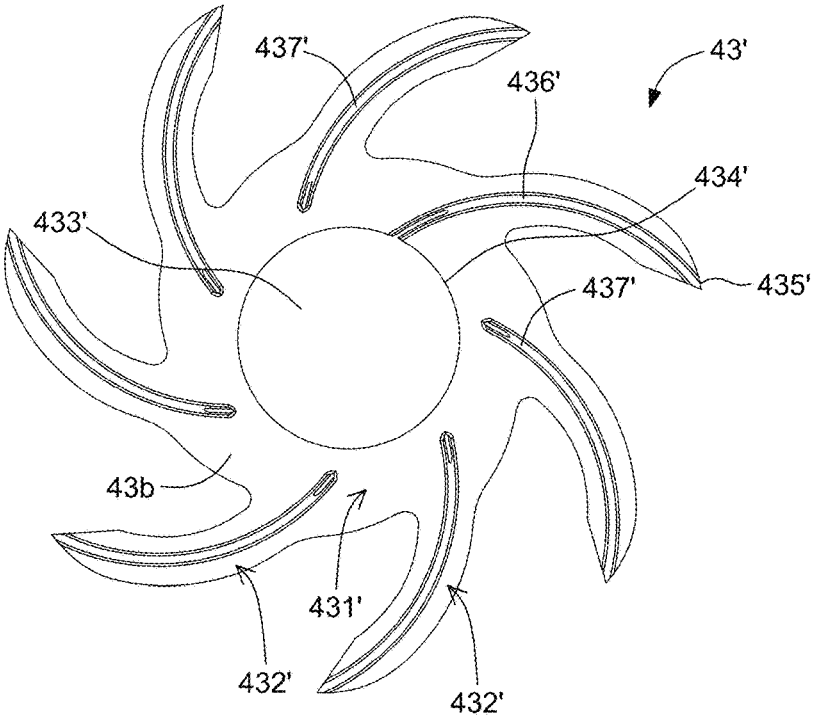
FIG. 12 illustrates a top view of an impeller according to some embodiments of the present disclosure.
Figure 13:
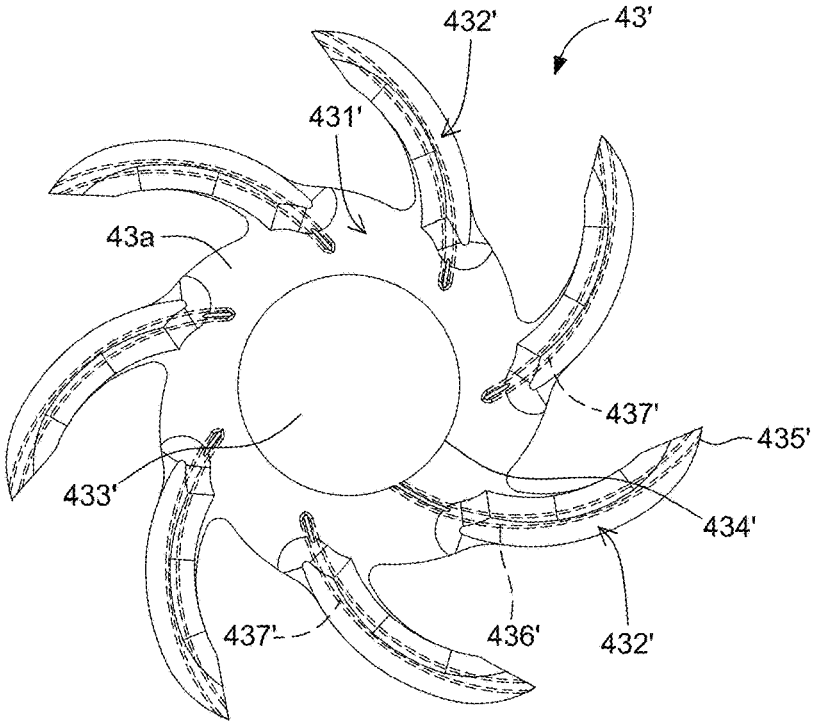
FIG. 13 illustrates a bottom view of an impeller according to some embodiments of the present disclosure.
Figure 14:
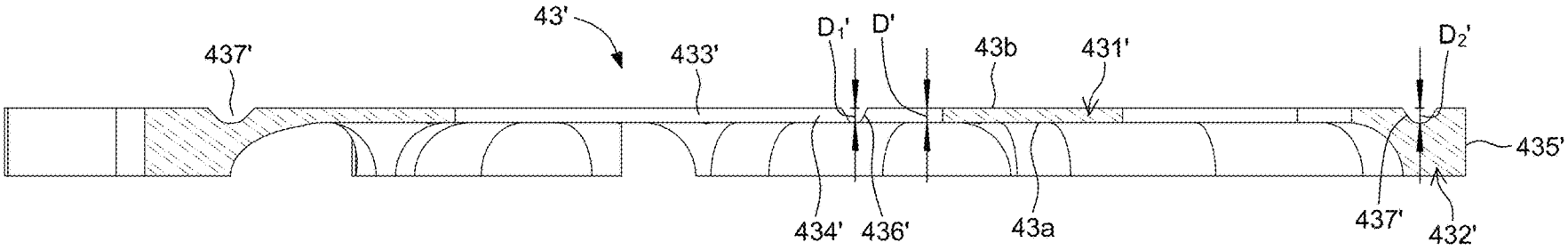
FIG. 14 illustrates a cross-sectional view of an impeller according to some embodiments of the present disclosure.

FIG. 9 illustrates an exploded perspective view of a water pump structure 1' according to some embodiments of the present disclosure. FIG. 10 illustrates a cross-sectional view of a water pump structure 1' according to some embodiments of the present disclosure. FIG. 11 illustrates an assembly view of a rotor 40' according to some embodiments of the present disclosure. FIG. 12 illustrates a top view of an impeller 43' according to some embodiments of the present disclosure. FIG. 13 illustrates a bottom view of an impeller 43' according to some embodiments of the present disclosure. FIG. 14 illustrates a cross-sectional view of an impeller 43' according to some embodiments of the present disclosure. The water pump structure 1' of FIG. 9 and FIG. 10 has a structure similar to the water pump structure 1 of FIG. 1 and FIG. 3, except for a structure of the impeller 43' of the rotor 40' in FIG. 9 and FIG. 10.

In some embodiments, as shown in FIG. 11 to FIG. 14, the impeller 43' can include a hub 431' and a plurality of blades 432'. One end of the plurality of blades 432' can be connected to the hub 431'. In some embodiments, the plurality of blades 432' can extend outward from the hub 431's edge. The central hole 433' in FIG. 11 to FIG. 14 is similar to the central hole 433 in FIG. 4 to FIG. 8, except for the size of the central hole 433'. The central hole 433' also has an inner edge 434'. The outer edge 435' in FIG. 11 to FIG. 14 is similar to the outer edge 435 in FIG. 4 to FIG. 8, except that the outer edge 435' can be the outermost edge of the plurality of blades 432'.

The at least one groove 436' in FIG. 11 to FIG. 14 is similar to the at least one groove 436 in FIG. 4 to FIG. 8, except that the at least one groove 436' can be disposed on the hub 431' and on one of the plurality of blades 432'. That is, a portion of the at least one groove 436' can be located on the hub 431', while another portion of the at least one groove 436' can be located on the blade 432'. In some embodiments, the at least one groove 436' can extend outward from the inner edge 434' of the central hole 433' along an arc-shaped path to the outer edge 435' of the impeller 43' (e.g., the outermost edge of the plurality of blades 432'). In some embodiments, as shown in FIG. 14, the depth $D_1'$ of the at least one groove 436' can be less than or equal to the depth D' of the central hole 433'.

The at least one guiding slot 437' in FIG. 11 to FIG. 14 is similar to the at least one guiding slot 437 in FIG. 4 to FIG. 8, except that the at least one guiding slot 437' can be disposed on the hub 431' and on at least one of the plurality of blades 432'. That is, a portion of the at least one guiding slot 437' can be located on the hub 431', while another portion of the at least one guiding slot 437' can be located on the at least one blade 432'. In some embodiments, the at least one guiding slot 437' can extend inward from the outer edge 435' (e.g., the outermost edge of the plurality of blades 432') along an arc-shaped path. In some embodiments, as shown in FIG. 14, the depth $D_2'$ of the at least one guiding slot 437' can be less than or equal to the depth D' of the central hole 433'. In some embodiments, the depth $D_1'$ of the at least one groove 436' can be greater than or equal to the depth $D_2'$ of the at least one guiding slot 437'.

While several embodiments of the present disclosure have been illustrated and described, various modifications and improvements can be made by those skilled in the art. The embodiments of the present disclosure are therefore described in an illustrative but not in a restrictive sense. It is intended that the present disclosure should not be limited to the particular forms as illustrated and that all modifications which maintain the spirit and scope of the present disclosure are within the scope defined in the appended claims.

What is claimed is:

1. A water pump structure, comprising:
a housing;
a rotor disposed in the housing, and the rotor comprising:
an impeller having a central hole, an outer edge, at least one groove and at least one guiding slot, wherein the at least one groove is in communication with the central hole, the at least one groove extends outward from an inner edge of the central hole to the outer edge of the impeller, and the at least one guiding slot extends inward from the outer edge and free from communicating with the central hole; and
a stator disposed around a periphery of the rotor and spaced apart form the rotor through a separation component disposed between the rotor and the stator.

2. The water pump structure of claim 1, wherein the housing defines a water inlet side and a water outlet side opposite to the water inlet side, and the at least one groove faces away from the water inlet side.

3. The water pump structure of claim 2, wherein the impeller has a first surface facing the water inlet side and a second surface facing away from the water inlet side, and the at least one groove is recessed from the second surface.

4. The water pump structure of claim 1, wherein the housing defines a water inlet side and a water outlet side opposite to the water inlet side, and the at least one groove faces the water outlet side.

5. The water pump structure of claim 1, wherein the at least one groove extends outward from the inner edge of the central hole along an arc-shaped path to the outer edge of the impeller.

6. The water pump structure of claim 1, wherein the housing comprises:
a first cover; and
a second cover combined with the first cover;
wherein there is a gap between the impeller and the second cover, and the at least one groove is in communication with the gap.

7. The water pump structure of claim 1, wherein the impeller includes a hub and a plurality of blades, and the plurality of blades and the at least one groove are located on two different sides of the hub.

8. The water pump structure of claim 7, wherein a downward projection of a portion of the at least one groove overlaps an upward projection of one of the plurality of blades.

9. The water pump structure of claim 7, wherein the at least one groove is misaligned with the blades.

10. The water pump structure of claim 1, wherein the impeller includes a hub and a plurality of blades, one end of the plurality of blades is connected to the hub, and the at least one groove is disposed on the hub and on one of the plurality of blades.

11. The water pump structure of claim 1, wherein the rotor further comprises:
a bearing seat configured to support the impeller;
a rotor magnet disposed around the bearing seat; and
a shaft sleeve disposed in the bearing seat and sleeved on a pivot shaft.

12. The water pump structure of claim 11, wherein the housing defines a water inlet side and a water outlet side opposite to the water inlet side, and the at least one groove is further away from the water inlet side than the shaft sleeve is.

13. The water pump structure of claim 11, wherein the housing defines a water inlet side and a water outlet side opposite to the water inlet side, and the at least one groove is further away from the water inlet side than the rotor magnet is.

14. The water pump structure of claim 1, wherein an extension length of the at least one groove is greater than an extension length of the at least one guiding slot.

15. The water pump structure of claim 1, wherein the impeller includes a plurality of blades, and a downward projection of a portion of the at least one guiding slot overlaps an upward projection of at least one of the plurality of blades.

16. The water pump structure of claim 1, wherein the impeller includes a plurality of blades, and the at least one guiding slot is misaligned with the blades.

17. A rotor, comprising:

an impeller having a central hole, an outer edge, at least one groove and at least one guiding slot, wherein the at least one groove is in communication with the central hole, the at least one groove extends outward from an inner edge of the central hole to the outer edge of the impeller, and the at least one guiding slot extends inward from the outer edge and free from communicating with the central hole.

18. The rotor of claim 17, further comprising:

a bearing seat configured to support the impeller;

a rotor magnet disposed around the bearing seat; and a shaft sleeve disposed in the bearing seat.

19. The rotor of claim 17, wherein the at least one groove extends outward from the inner edge of the central hole along an arc-shaped path to the outer edge of the impeller.

* * * * *